US006206963B1

(12) United States Patent
Abrahams

(10) Patent No.: US 6,206,963 B1
(45) Date of Patent: Mar. 27, 2001

(54) NOZZLE

(75) Inventor: Siegfried Helmut Abrahams, Richmond, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/139,489

(22) Filed: Aug. 25, 1998

(51) Int. Cl.[7] ..... B05B 1/02; B05C 11/00; B05D 7/24

(52) U.S. Cl. ..... 118/300; 118/323; 427/207.1; 427/286; 427/356; 427/359; 156/359; 239/323; 239/601

(58) Field of Search ..... 118/300, 307, 118/410, 429, 324, 315, 323; 427/207.1, 356, 268, 286; 239/119, 128, 601; 221/1; 156/352, 356

(56) References Cited

U.S. PATENT DOCUMENTS

| | | | | |
|---|---|---|---|---|
| 3,146,950 | | 9/1964 | Lancaster | 239/128 |
| 3,435,834 | | 4/1969 | Cooper | 134/98 |
| 3,791,590 | | 2/1974 | Dieter | 239/459 |
| 4,098,915 | | 7/1978 | Warning, Sr. et al. | 427/8 |
| 4,249,547 | | 2/1981 | Hinzmann | 131/94 |
| 4,365,585 | | 12/1982 | Naylor et al. | 118/302 |
| 4,420,635 | | 12/1983 | Washington et al. | 562/555 |
| 4,562,099 | | 12/1985 | Hinchcliffe | 427/282 |
| 4,581,276 | * | 4/1986 | Kunert et al. | 428/157 |
| 4,669,661 | | 6/1987 | Otto | 239/132.1 |
| 4,753,824 | * | 6/1988 | Toda et al. | 427/286 |
| 4,763,672 | | 8/1988 | Gregory, III | 131/79 |
| 4,895,603 | | 1/1990 | Semp et al. | 134/21 |
| 4,933,032 | * | 6/1990 | Kunert | 156/108 |
| 5,061,519 | | 10/1991 | Long | 427/207.1 |
| 5,165,961 | * | 11/1992 | Freeman | 118/410 |
| 5,221,348 | | 6/1993 | Masano | 118/506 |
| 5,263,608 | | 11/1993 | Kiernan et al. | 222/1 |
| 5,314,559 | | 5/1994 | Rinehart et al. | 156/356 |
| 5,356,050 | | 10/1994 | Hahn et al. | 222/394 |
| 5,516,224 | | 5/1996 | Moshammer | 401/266 |
| 5,553,758 | | 9/1996 | Melendy et al. | 222/533 |
| 5,558,743 | | 9/1996 | Focke et al. | 156/352 |
| 5,720,433 | | 2/1998 | Forker | 239/119 |

* cited by examiner

*Primary Examiner*—Richard Crispino
*Assistant Examiner*—J. A. Lorengo
(74) *Attorney, Agent, or Firm*—Clinton H. Hallman, Jr.; Kevin B. Osborne; Charles E. B. Glenn

(57) ABSTRACT

A nozzle for the application of a fluid to a passing substrate in a bead form. The nozzle has a portion of the nozzle tip removed, preferably an anterior or aft portion, such that an even bead of a preselected depth may be applied to a workpiece to provide a reliable sealing joint

7 Claims, 3 Drawing Sheets

NOZZLE

I. BACKGROUND OF THE INVENTION

A. Field of the Invention

The present invention relates to the field of systems for moving application of a bead of adhesive on a substrate. More specifically, the invention is useful to deposit a thin line of heated glue upon a paper-based substrate to facilitate, e.g. cigarette, cigarette filter, package, carton or case manufacture on an automated production line.

B. Description of the Prior Art

Modern equipment involved in the preparation of packaged consumer goods have made the production of vast quantities of products in short times feasible. For example, today's cigarette machines manufacture cigarettes at a speed of up to 14,000 cigarettes per minute. Several machines working in tandem can now reliably produce in excess of a billion units per day.

Cigarettes are conventionally packaged in packs of 20, although specialty consumer product packs of other goods with varying sizes may contain more or fewer items. On average, then, a single high speed machine can manufacture the equivalent of 700 packs of cigarettes per minute, over 10 packs per second. Other consumer goods are also packaged at high speeds as well (for example, individually wrapped cheese slices and the like). These other goods may be sealed in individual packages for resale in a desired multiple.

With such high speeds of manufacture, down time can be created by a number of factors, and the avoidance of a jammed machine due to mechanical failures is to be avoided as it can cause great expense. One such failure can be caused by inaccurate application of a bead of glue for sealing purposes, causing the packaging or paper wrapper to come undone in the midst of processing. An inaccurately placed bead of glue can cause the final product or a component thereof to have aesthetic defects.

The prior art is replete with attempts to remedy this situation, and attempts to develop nozzles for spraying adhesives and other liquids.

U.S. Pat. No. 3,146,950 issued Sep. 1, 1964 to Lancaster discloses a pressure spraying apparatus with a conventional nozzle. The unit has a hand held nozzle with dual feed lines from liquids at differing temperatures to maintain the temperature of the material (e.g. polyurethane foam) being sprayed.

A demand-served glue nozzle is disclosed in U.S. Pat. No. 3,791,590 in which a glue nozzle is formed with a central bore having a valve stem or plunger. The nozzle exterior has a tapered surface coming to a flat rim point with a convex surface. When the nozzle approaches a workpiece, the plunger releases glue. When the nozzle retracts, the glue supply is shut off and excess glue maintained in the convex surface.

U.S. Pat. No. 4,098,915 discloses a liquid spray head having a needle valve in a spray head. The needle valve is retracted and permits glue to exit from an annular opening surrounding the conical surface of the needle valve.

U.S. Pat. No. 4,249,547 discloses a glue-applying roller with grooves of varying depth to pick up glue from a supply of adhesive and transfer varying amounts of adhesive onto a running web of tipping paper.

U.S. Pat. No. 4,365,585 discloses a spraying device for the application of additives to tobacco. A spraying tip protrudes from a nozzle head which has a plurality of orifices around its periphery. The orifices can contain additive liquid, atomizing liquid, and a cleaning medium. The cleaning medium (e.g. air) is directed to clean the spraying tip.

U.S. Pat. No. 4,562,099 discloses a rotary gravure gummer which is a cylindrical member partly immersed in a bath of adhesive. The adhesive is captured in bores extending through the rotary member and excess is scraped off. The bores deliver the adhesive pattern to a workpiece.

U.S. Pat. No. 4,669,661 discloses the spraying of hot-melt glue through a nozzle with pressurized air. The nozzle is fed by a pneumatically operated extrusion gun.

U.S. Pat. No. 4,895,603 discloses an apparatus and method for cleaning and priming a nozzle assembly. An internal control delivers a rinsing solution to a nozzle, then reprimes the nozzle.

U.S. Pat. No. 5,061,519 discloses an apparatus for patterned gluing. A rotatable shaft supports a plurality of glue nozzles which have ball bearing valves at their tips to release glue on contact with an article.

U.S. Pat. No. 5,221,348 discloses a high pressure manual glue injector with opposed finger grips and a piston which feeds glue to a tapered nozzle upon compression by a user.

U.S. Pat. No. 5,263,608 discloses a method and apparatus for dispensing a constant controlled volume of adhesive. This disclosure, which is incorporated herein in its entirety, describes a method and apparatus for controlling the flow of adhesive onto a moving substrate using a thermal flowmeter. A supply of glue is fed into the nozzle and a spring loaded needle valve, controlled by a supply of pressurized air, is retracted or extended, depending on the amount of glue needed to be extruded onto a passing surface.

U.S. Pat. No. 5,314,559 discloses an apparatus for applying glue to closure stamps for insertion onto packages. A rotatable glue-applying wheel with a recessed radial edge applies a pattern of glue to closure stamp.

U.S. Pat. No. 5,356,050 discloses a mechanism for applying droplets of glue onto sheets. A needle is inserted into a vertical chamber. A droplet of glue forms on the needle, and a blast of air removes the droplet and deposits it on the sheet below.

U.S. Pat. No. 5,553,758 discloses an apparatus for the application of hot melt adhesives using a variety of nozzles. Of particular interest are the nozzle of FIGS. 2A and 2B which are said to be particularly useful for the application of a thin layer of adhesive.

U.S. Pat. No. 5,656,084 discloses a process for coating glue onto pack blanks for the production of hinge-lid packs. A gluing unit having a standard conical nozzle is seen at FIG. 6.

Finally, U.S. Pat. No. 5,720,433 discloses a drawback valve for a glue gun which has a poppet inside a stem which serves as a piston to draw back the glue when the valve is closed to prevent drips.

The above art applies adhesives, but generally in the form of a smear or spray upon the surface, which is not as precise as desired for quality manufacturing procedures. For the glue to transfer to the paper, a form of contact or spray is required. The known prior art results in a smear or spray as noted above. Smears are by their very nature unpredictable and can accumulate along a nozzle in globs, and a spray can result in glue being misapplied and vapor depositing on other portions of the machine, leading to agglomeration of deposits and particles, resulting in a potential for jams and failure. A solution, resulting in an evenly applied bead of adhesive or other liquid is desired.

II. OBJECTS OF THE INVENTION

The apparatus according to the present invention contemplates providing a glue nozzle which alleviates the problems noted above.

It is an object of the present invention to provide a nozzle with a defined orifice to allow the fluid adhesive to be evenly applied to a perpendicularly moving substrate.

It is another object of the present invention to provide a nozzle which provides an evenly applied bead of adhesive of a uniform placement and depth.

It is another object of the present invention to provide a nozzle which allows less adhesive to be applied more precisely, resulting in a savings of material.

It is another object to provide an improved method of gluing a substrate by providing a bead which has improved sealing performance.

III. SUMMARY OF THE INVENTION

The present invention contemplates providing an apparatus and method for applying a thin elongate length of adhesive or other liquid onto a surface which is passing relative to an orifice. The elongate length of adhesive will have a generally uniform depth at a precisely controlled location.

More specifically, the apparatus provides a nozzle for a glue gun or glue applying machine which allows a perpendicularly placed substrate to receive a bead of glue without significant flattening, squirting, or splattering.

IV. BRIEF DESCRIPTION OF THE DRAWINGS

The invention is most easily understood with reference to the figures which follow.

V. DETAILED DESCRIPTION

The present invention provides an improved glue nozzle for use in applications where the nozzle is moving relative to the paper (or, where the paper is moving relative to the nozzle). It is preferred that the nozzle remain stationary while the substrate passes beneath the nozzle.

In the manufacture of, e.g. cigarettes or cigarette components such as filters or spacers, it is known to provide rolls of flexible web materials of paper on long spools known as bobbins. The bobbins are fed from the spools or reels through machines for manufacturing the components or cigarettes. For example, a column of tobacco wrapped in paper is manufactured for incorporation into a filter cigarette by providing the tobacco along a belt, and wrapping the tobacco with a paper wrapper. The paper wrapper is held in place by a thin strip of adhesive applied at one edge of the wrapper before the cigarette wrapper is closed around the column of tobacco. Filters, similarly, are manufactured by providing filter material, compressing it in a roughly circular pattern, applying fixatives, and wrapping the assembly in paper which has an adhesive applied along one edge of the paper or porous plug wrap.

The cylindrical cigarettes or cigarette components are more specifically formed by closing the wrapper about the mass of tobacco or other material contained therein by bending the wrapper about a garniture and applying pressure on the edge to bring the paper or wrapper edges together with the adhesive disposed therebetween. The pressure may be applied by a cooling bar in the case of hot melt adhesive, or a heater bar in the case of PVA (polyvinyl acrylate) adhesives.

Other packaged goods, such as cereals, cartons, and boxed goods are sealed by applying a strip of glue at edge flaps and closing those flaps.

The present invention contemplates supplying an adhesive along a substrate for these and similar uses.

Figure 1:
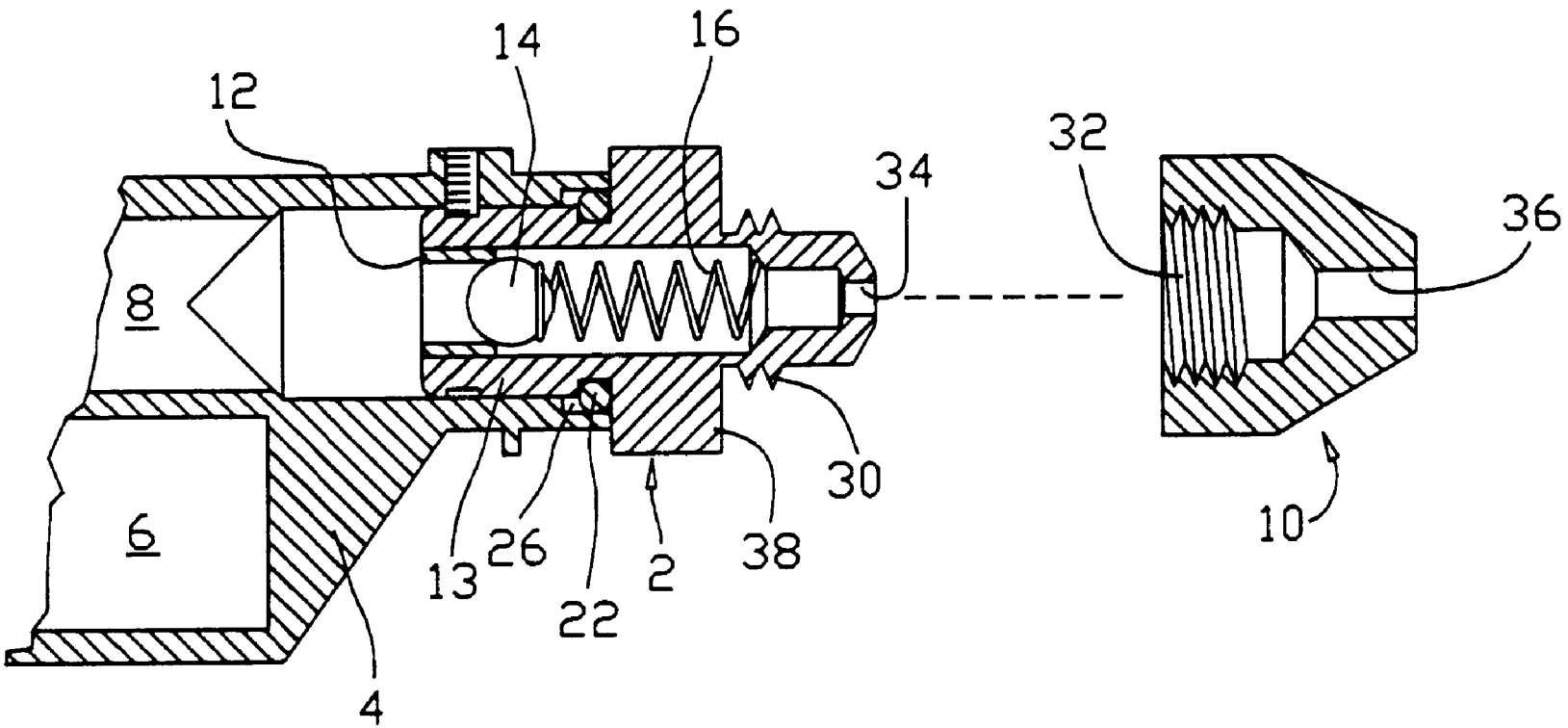
Fig. 1 (PRIOR ART)
FIG. 1 is a cross sectional view of a prior art glue applying device.

Turning now to FIG. 1, a prior art nozzle cap 10 is seen in conjunction with a nozzle body 2. A heat casting 4 includes a cavity 6 for receiving a heating element and a glue chamber 8 for receiving hot melt glue. The nozzle cap 10 fits over the end of the nozzle body and controls the shape of the dispensed glue.

A bushing 12, ball 14, and spring 16 act as a check valve to stop the flow of glue to the nozzle when pressure in chamber 8 is lessened.

The ball-spring arrangement may be substituted for a needle valve or other glue dispensing means which is known per se in the art.

The nozzle cap 10 is formed with a threaded inner cavity 32 and discharge port 36. The threaded inner cavity mates with the elongated threaded tip 30 of the nozzle body and threadedly engages the nozzle body and tip. Discharge port 36 mates with discharge tube 34 to provide a glue dispensing pathway.

In use, the nozzle generally abuts the substrate passing the nozzle (usually underneath). This is required for transfer of the glue from the nozzle to the substrate reliably in a non-spray application. Thus, the nozzle and substrate when in contact can cause the glue or other liquid substance to squirt out from any side of the nozzle head. The nozzle will also tend to flatten the glue bead being applied.

This flattening will cause the hot glue to cool more quickly and potentially lose tackiness. Thus, the rate of glue application must be enhanced to maintain sufficient sealing or adhesive action. A rod heater device, which provides heat to the bead prior to a folding or sealing step to renew tackiness, has to be used at slow speeds as the glue cools down too quickly and loses its sealing ability.

Figure 2:
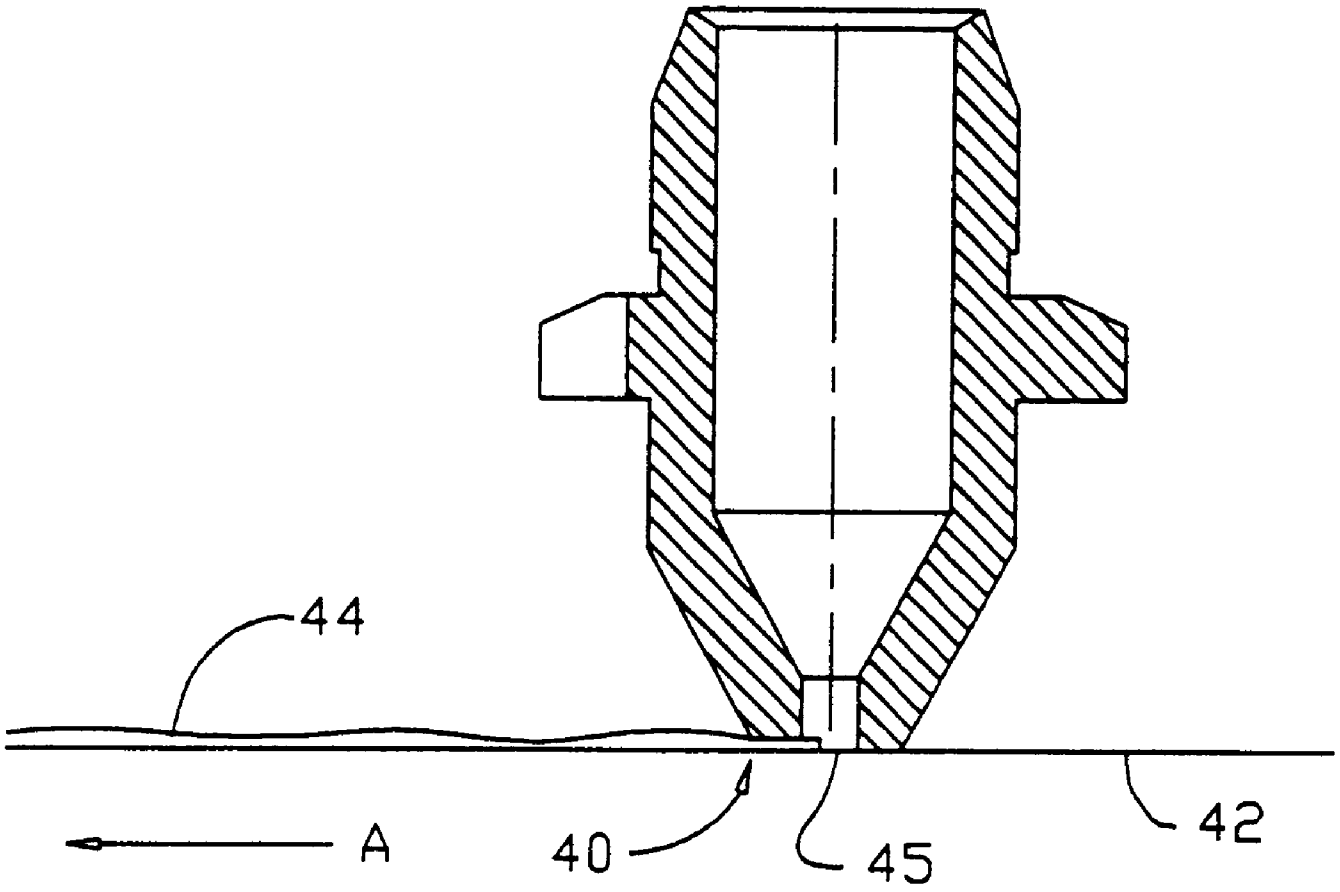
FIG. 2 is a cross sectional view of a device according to the present invention.

Turning now to FIG. 2, a cross sectional view of a nozzle according to the present invention is seen. The nozzle has relief section 40 provided to enhance the glue line delivery characteristics. Substrate 42 is traveling in the direction of arrow A and adhesive substance 44 is being deposited onto the surface 42.

The relief section can be from 0.1 to 5.0 mm in depth, but is preferably from about 0.1 to 0.3 mm for a hot-melt adhesive, PVA adhesive, or similar adhesive substances. The width is generally at least the same as the nozzle orifice 45. The orifice can vary in size from 0.5 to 5 mm, more preferably from 1 to 2 mm, most preferably 1.5 mm. The adhesives being applied are generally applied at a predetermined flow rate which is matched to the speed of the passing substrate. Preferably, this is a low pressure delivery system allowing a uniform flow of glue. The glues which may be used include, but are not limited to, hot melt adhesive, PVA adhesive, EVA adhesives, and liquid starch.

Figure 3:
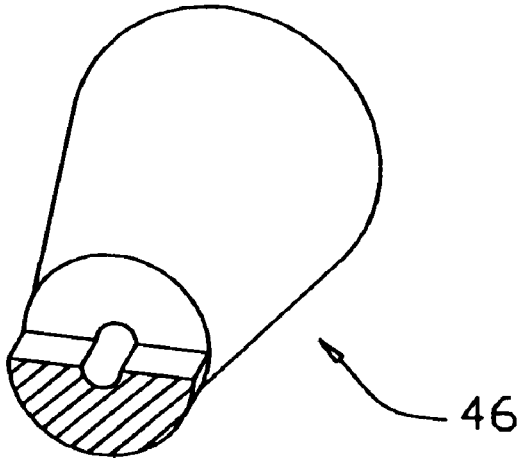
FIG. 3 is a perspective drawing of a preferred embodiment according to the present invention.
Figure 4:
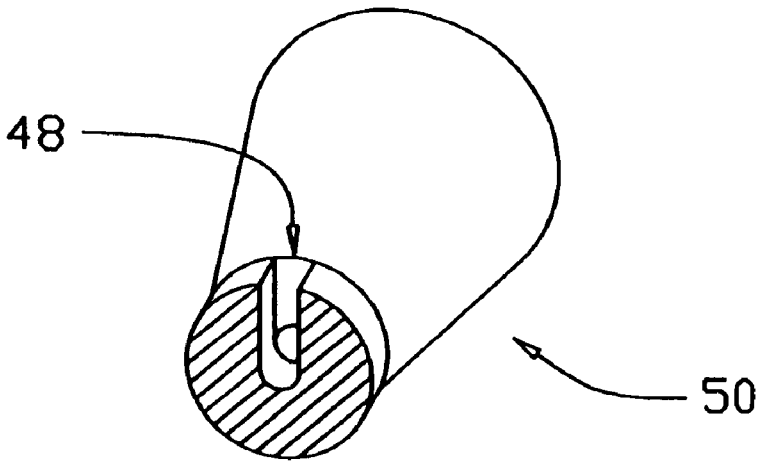
FIG. 4 is a perspective drawing of a preferred embodiment according to the present invention.

Relief section 40 is a channel cut into the tip of the nozzle which contacts the substrate. It may be seen in the embodiment of FIG. 3, which is a straight edged removal of a portion of material from the aft end of the nozzle 46, or a channel 48 may be formed within the nozzle 50 as seen in FIG. 4.

One feature of the instant invention which helps provide an even application of adhesive is the providing of a protected channel for the glue to pass through up until the point of contact with the substrate. The glue is thus not "free" to fall into contact with the substrate, rather its descent is controlled by the orifice up until it is carried away by the lateral motion of the substrate. The relief allows the glue to be carried away uniformly without accumulating in undesired locations. The depth of the channel is preselected to assure a uniform application in a precisely selected location.

The passage of a substrate at high speed causes wear upon nozzles, therefore the nozzle itself can be made from stainless steel, but is preferably a solid carbide or a hardened steel.

Surprisingly, the nozzle according to the present invention does not show unfavorable wear characteristics when compared to a full nozzle.

Also surprisingly, the nozzle according to the present invention showed a significant reduction in overall glue flow when compared to machines equipped with a prior art nozzle. A Hauni KDF 2D filter making machine (available from Hauni-Werke Korber & Co., Hamburg, Germany) equipped with a standard nozzle utilizes approximately 28 gm/min operating at 2500 filters/minute.

With the nozzle according to the present invention, the glue flow rate can be reduced to 16 gm/min or lower at 2500 filters/minute—a savings of over 42% for similar sealing capabilities on a filter making machine. Additionally, the speeds of the machine may be reduced considerably without significant diminution in the quality of the side seam of a cigarette or filter.

Having described the invention as above, we claim:

1. An apparatus for the application of a line of fluid to a substrate moving relative to the apparatus, comprising:

a nozzle for dispensing the fluid said nozzle being conical in shape and tapering down to a narrow tip said, tip having an aft edge said nozzle and tip having a passage therethrough, and a relief channel formed within said tip for allowing lateral fluid flow out from the tip, wherein said relief channel comprises a groove extending from said passage to said aft edge.

2. An apparatus as claimed in claim 1, wherein the nozzle is substantially perpendicular to the substrate.

3. An apparatus for the application of a line of fluid to a substrate moving relative to the apparatus, comprising:

a nozzle for dispensing the fluid said nozzle being conical in shape and tapering down to a narrow tip, said tip having an aft edge and said nozzle being substantially perpendicular to said substrate, said nozzle and tip having a passage therethrough; and a relief channel formed within said tip for allowing lateral fluid flow out from the tip, said relief channel comprising a groove extending from said passage to said aft edge, wherein the relief channel has a height of from 0.05 mm to 5 mm.

4. An apparatus for the application of a line of fluid to a substrate moving relative to the apparatus, comprising:

a nozzle for dispensing the fluid said nozzle being conical in shape and tapering down to a narrow tip said tip having an aft edge and said nozzle being substantially perpendicular to said substrate, said nozzle and tip having a passage therethrough; and a relief channel formed within said tip for allowing lateral fluid flow out from the tip, said relief channel comprising a groove extending from said passage to said aft edge, wherein the relief channel has a height of from 0.1 to 0.3 mm.

5. An apparatus for the application of a line of fluid to a substrate moving relative to the apparatus, comprising:

a nozzle for dispensing the fluid said nozzle being conical in shape and tapering down to a narrow tip said, tip having an aft edge said nozzle and tip having a passage therethrough; and a relief channel formed within said tip for allowing lateral fluid flow out from the tip, said relief channel comprising a groove extending from said passage to said aft edge, wherein the passage width is from 0.5 mm to 5 mm.

6. An apparatus for the application of a line of fluid to a substrate moving relative to the apparatus, comprising:

a nozzle for dispensing the fluid said nozzle being conical in shape and tapering down to a narrow tip said, tip having an aft edge said nozzle and tip having a passage therethrough; and a relief channel formed within said tip for allowing lateral fluid flow out from the tip, said relief channel comprising a groove extending from said passage to said aft edge, wherein the passage width is from 1 to 2 mm.

7. An apparatus for the application of a line of fluid to a substrate moving relative to the apparatus, comprising:

a nozzle for dispensing the fluid said nozzle being conical in shape and tapering down to a narrow tip said, tip having an aft edge said nozzle and tip having a passage therethrough; and a relief channel formed within said tip for allowing lateral fluid flow out from the tip, said relief channel comprising a groove extending from said passage to said aft edge, wherein the passage width is about 1.5 mm.

* * * * *